United States Patent [19]

Michlovic

[11] Patent Number: 4,854,095

[45] Date of Patent: Aug. 8, 1989

[54] COLOR CAP SYSTEM FOR LOCKING STRIP GASKETS

[75] Inventor: John J. Michlovic, Avon Lake, Ohio

[73] Assignee: The Standard Products Company, Cleveland, Ohio

[21] Appl. No.: 114,580

[22] Filed: Oct. 29, 1987

[51] Int. Cl.[4] ..... E04H 1/00

[52] U.S. Cl. ..... 52/235; 52/403; 52/468; 52/395

[58] Field of Search ..... 52/235, 242, 236.3, 52/483, 466, 467, 469, 456, 395, 398, 465, 403, 772

[56] References Cited

U.S. PATENT DOCUMENTS

| | | | |
|---|---|---|---|
| 3,766,698 | 10/1973 | Dallen | 52/235 |
| 4,640,072 | 2/1987 | Muhle | 52/403 |
| 4,648,231 | 3/1987 | Laroche | 52/468 X |

*Primary Examiner*—David A. Scherbel
*Assistant Examiner*—Creighton Smith
*Attorney, Agent, or Firm*—Harness, Dickey & Pierce

[57] ABSTRACT

A system is disclosed to add color to a locking strip gasket curtainwall having a plurality of vertical and horizontal gasket strips; each gasket strip having an outer periphery. The system comprises a mechanism for covering the vertical and horizontal gasket strips. The covering mechanism has an inner periphery having a shape substantially corresponding to the outer periphery of the gasket strips to be adapted to abut the gasket strip. A member projects from the inner periphery of the covering mechanism to secure the covering mechanism into the locking strip cavities of the gasket strips. This member replaces the conventional locking strip. A pigmented mechanism is coupled with the covering mechanism to provide the covering mechanism with a tinted aesthetic appearance.

16 Claims, 2 Drawing Sheets

COLOR CAP SYSTEM FOR LOCKING STRIP GASKETS

BACKGROUND AND SUMMARY OF THE INVENTION

The present invention relates to curtain wall gasket systems. More particularly, the invention relates to a system adapted to provide color in a resilient locking strip gasket curtainwall system.

In curtainwall systems which utilize resilient neoprene gaskets to retain glass panels within openings in a building, the gasket strips are ordinarily extruded, cut to proper length and then joined together at corners, T's and cross intersections by an injection molding process to create a large ladder gasket. Due to the molding process and the type of neoprene rubber used, the ladder gasket has a characteristic black color. Architects and designers are always searching for products which will enable them to explore various color combinations which add aesthetic beauty and color to their building.

Presently, aluminum frames which include sealing elements to seal the glass panels are used in curtainwall window systems. These aluminum frames may be painted or anodized to provide color to the building. Also, stainless steel may be used to provide an aesthetically appealing appearance. However, these metallic curtainwall systems have several disadvantages. The aluminum framing does not provide the curtainwall system with adequate thermalbreak insulation. Sound will vibrate through the metallic frame system into the building creating unwanted noise. Further, metallic framing must be regularly maintained either by repainting, refinishing, or the like to prevent the metallic framing from pitting, rusting, and/or deteriorating or the like.

Accordingly, it is an object of the present invention to overcome the disadvantages of the above art. The present invention provides the architect/designer with the capability of utilizing color in a resilient gasket curtainwall system. The resilient gasket provides the art with thermalbreak insulation, reduction in noise levels passing through the building, and also the gasket system is substantially maintenance free. Additionally, the present invention eliminates the need for the conventional locking strips by providing a unique built-in mechanism for attachment and sealing of the glass.

The present invention provides the art with a new and improved system to add color to a resilient gasket curtainwall system having a plurality of vertical and horizontal gasket strips. The vertical and horizontal gasket strips each have an outer periphery and form intersections at their junctions. The system includes vertical and horizontal cap strips which have an inner periphery substantially ) corresponding to the outer periphery of the gasket strips. A member projects from the inner periphery of the cap strips to secure the cap strips into the locking strip cavities of the vertical and horizontal gasket strips thereby eliminating the conventional locking strip. The cap strips are painted or anodized to provide an appealing aesthetic appearance.

From the subsequent description and the appended claims taken in conjunction with the accompanying drawings, additional objects and advantages of the present invention will become apparent to one skilled in the art.

Figure 2:
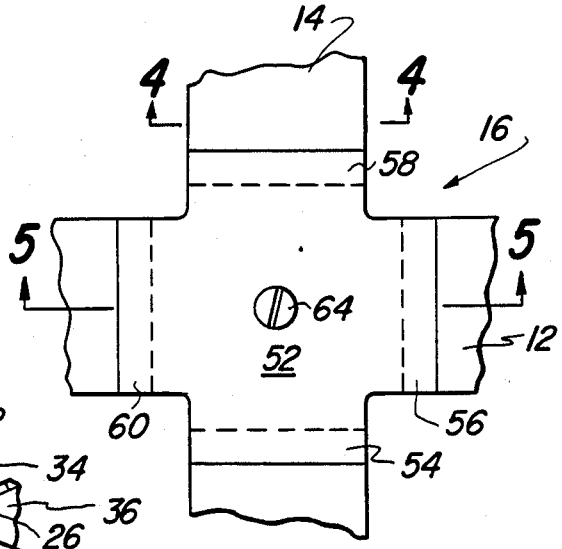
FIG. 2 is an enlarged view of FIG. 1 within circle 2.

FIG, 3 is a partial exploded perspective view of FIG. 2.

Figure 4:
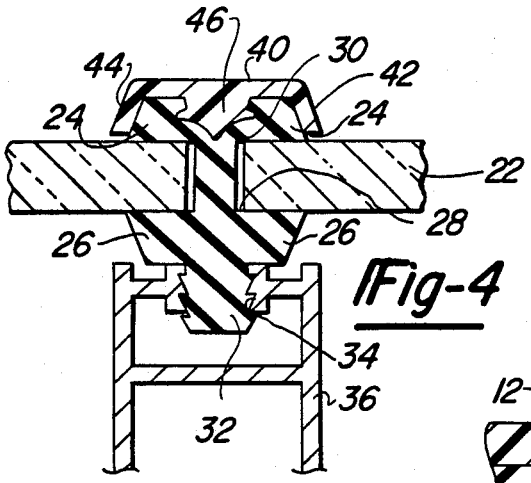

FIG. 4 is a cross-sectional view of FIG. 2 along line 4—4 thereof.

Figure 5:
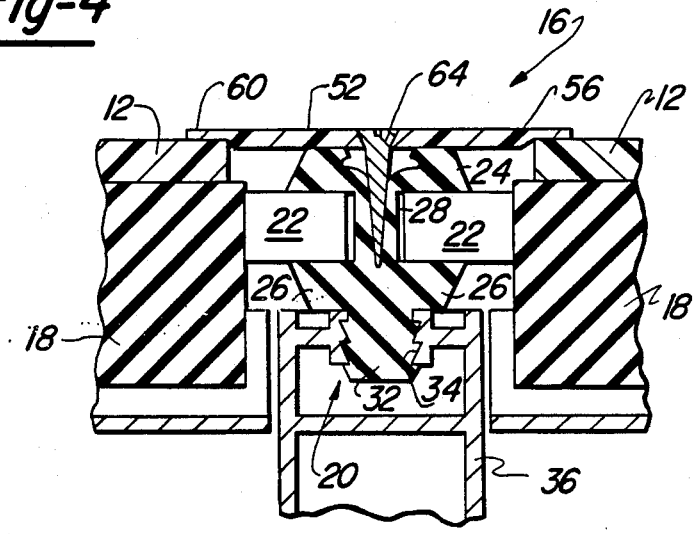

FIG. 5 is a cross-sectional view of FIG. 2 along line 5—5 thereof

Figure 6:
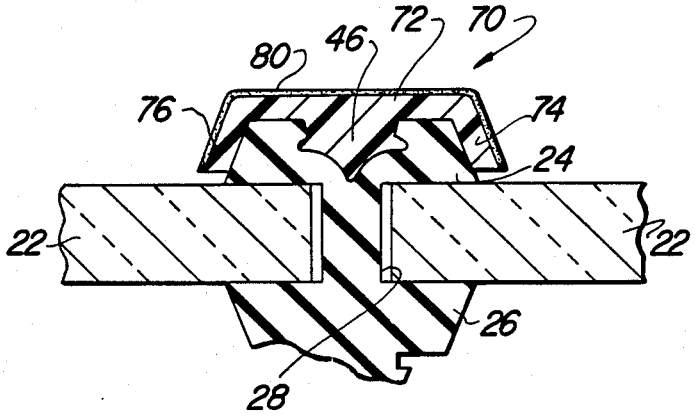

FIG. 6 is a cross-sectional view of a second embodiment of the present invention.

DETAILED DESCRIPTION OF THE PREFERRED EMBODIMENT

Figure 1:
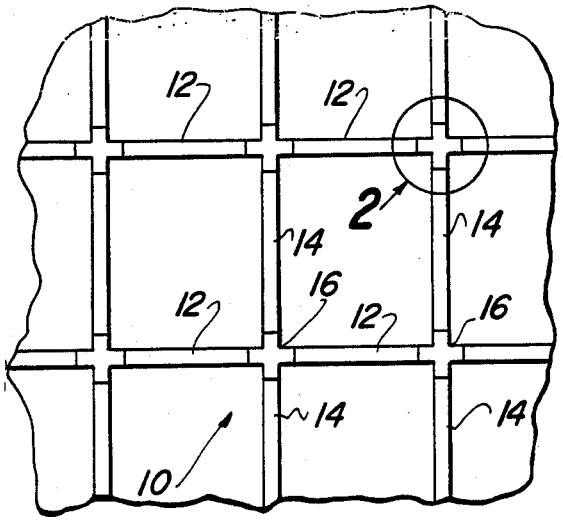
FIG. 1 is a partial elevation view of a curtainwall system including the color system in accordance with the present invent

Referring to the Figures, particularly FIG. 1, a system to add color to a gasket glazed curtainwall system is shown and designated with the reference numeral 10. The system is generally comprised of a plurality of horizontal and vertical cap strips 12 and 14, respectively, and several covering joint fittings 16.

Figure 3:
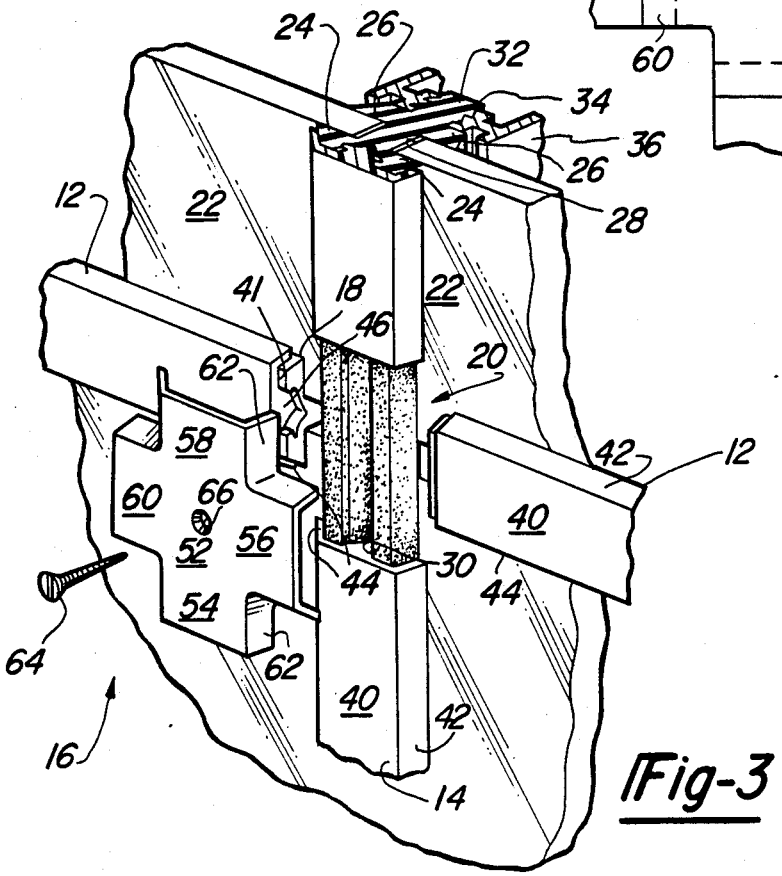

Moving to FIGS. 2 through 5, a better understanding of the color system is presented. The horizontal and vertical cap strips 12 and 14 are coupled with horizontal and vertical gasket strips 18 and 20, respectively. The gasket strips 18 and 20 secure glass panels 22 within the gasket curtainwall system, as seen in FIG. 3. The horizontal and vertical gasket strips 18 and 20 are substantially identical and include a pair of wings 24 and 26 which form a glass receiving channel 28 for the glass panels 22 to retain the glass panels 22 within the gasket strips 18 and 20, as seen in FIGS. 3 and 4. A locking strip cavity 30 is formed in the outer periphery of the gasket strips 18 and 20 to receive the horizontal and vertical cap strips 12 and 14. The gaskets 18 and 20 have a anchoring spline 32 to secure the gasket strips within a channel 34 on the retaining frame 36.

The cap strips 12 and 14 are substantially identical and the following description will apply to both. The cap strips 12 and 14 are elongated members having an inner periphery configuration substantially corresponding to the outer periphery of the gasket strips 18 and 20 to abut against the outer periphery of the gasket strips. Generally, the cap strips 12 and 14 have a major face 40 and a pair of integral flanges angularly projecting therefrom forming two minor faces 42 and 44. The cap strips 12 and 14 ordinarily fit over the gasket strips 18 and 20 to effectively shield the view of the gasket strips 18 and 20 from the viewer.

A member 46 projects from the opposing side 41 of the major face 40. The member 46 has a shape to frictionally engage the gasket strips 18 and 20 within the locking strip cavity 30. The projecting member 46 secures the cap strips 12 and 14 onto the gasket strips 18 and 20 while exerting force on the wings 24 and 26 to secure the glass panels 22 within the gasket strips 18 and 20.

The cap strips 12 and 14 and member 46 may be manufactured from a polymeric plastic or nylon material, such as Hyplon polymer, containing stable color pigments. The cap strips 12 and 14 generally are extruded from the polymeric material to form the elongated strips, as described herein. Also, the cap strips 12 and 14 may be made by extruding a metallic material. In this case, the cap strips 12 and 14 include a pigmented exterior film coating which will be described herein.

A joint fitting 16 is positioned over the gasket strips 18 and 20 at the intersections of the vertical and horizontal covering strips 12 and 14. The joint fitting 16 includes a body portion 52 and a plurality of legs 54, 56, 58 and 60. A screw or the like 64 is passed through body aperture 66 of the joint fitting 16 to secure the joint fitting 16 onto the gasket, as seen in FIG. 5. It will be noted that in the drawings, the joint fitting includes four legs, however, the joint fitting may have two legs and form an "L" or three legs to form a "T" when two or three, respectively, gasket strips intersect. Skirts 62 depend from legs 54, 56, 58 and 60 to conform with the cap strips 12 and 14 at their intersection to provide a continuous appearance to the cap strips. Also, joint fittings like those described in my co-pending U.S. patent application entitled "Cap Fitting For Gasket System Intersections", Ser. No. 114,579, filed the same day as the present application, the specification of which is herein incorporated by reference, may be utilized in the present system.

The joint fitting legs 54, 56, 58 and 60 are substantially thinner at their extending ends than the remainder of the legs 54, 56, 58 and 60, and body 52, as illustrated in FIG. 5. The tapered ends provide the system with an overall continuous appearance.

Also, it is possible to have the cap strips 12 and 14 abut one another to eliminate the cover fitting 16. In this case, one of the cap strips 12 or 14 would pass through the intersection and the other cap strips would abut it.

Turning to FIG. 6, a second embodiment of the present invention is shown. FIG. 6 illustrates a cross-section view of the present invention through a cap strip 70. The cap strip 70 is substantially the same as those herein described. The cap strip 70 has an inner periphery substantially corresponding to the outer periphery of the gasket strips 18 and 20 to enable abutment. The outer periphery of the cap strip 70 includes a pigmented film 80 which is bonded to the major face 72 and minor faces 74 and 76. The pigmented film 80 may be paint, plastic film or the like and may be of any desired color. The film 80 may be bonded to a polymeric or metallic covering strip.

While the above discloses the preferred embodiment of the present invention, it will be understood that modifications, variations, and alterations may be made to the present invention without varying from the scope and fair meaning of the subjoined claims.

What is claimed is:

1. A system for adding color to a resilient gasket curtainwall system having a plurality of vertical and horizontal gasket strips, each gasket strip having an outer periphery and said vertical and horizontal gasket strips forming intersections at their junctions, said color system comprising:

means for entirely covering said vertical and horizontal gasket strips, said covering means having an inner periphery having a shape substantially corresponding to the outer periphery of said gasket strips and adapted to abut said outer periphery of said gasket strips so that said covering means covers the entire outer periphery of said gasket strips;

means projecting from said inner periphery of said covering means for securing said covering means into locking strip cavities of said gasket strips; and pigmented means coupled with said covering means for providing said covering means with a tinted aesthetic appearance.

2. The system according to claim 1 wherein said cover means further comprises a plurality of elongated strips having an inner periphery substantially corresponding to the outer periphery of said gasket strips and including a member projecting from said inner periphery for securing said elongated strips in said locking strips cavities of said vertical and horizontal gasket strips, a plurality of joint fittings having a body portion and at least two leg portions, said leg portions abutting said elongated strips for providing a continuous covering on said gasket strips, and a means for coupling said joint fittings with said gasket strips.

3. The system according to claim 2 wherein said elongated strips and joint fittings are formed from a polymeric material.

4. The system according to claim 3 wherein said polymeric material is Hyplon polymer.

5. The system according to claim 3 wherein said pigment means is added directly to said polymeric material prior to forming the elongated strips.

6. The system according to claim 1 wherein said pigment means comprises a pigmented film layer applied to said cover means.

7. The system according to claim 2 wherein said elongated strips and joint fittings are formed from a metallic material.

8. The system according to claim 7 wherein said pigment means comprises a pigmented film layer applied to said elongated strips and joint fittings.

9. A glazing system comprising:

gasket means, said gasket means including a plurality of vertical and horizontal strips, said strips having a glass receiving channel, an anchoring spline, and an outer periphery with a looking strip cavity therein;

a frame network defining a curtaintail with intersecting vertical and horizontal frame members, each member adapted to receive said gasket means;

a plurality of glass panels positioned into said glass receiving channels such that the perimeter of the glass panels is received by said gasket strips;

means for entirely capping said vertical and horizontal strips, said capping means having an inner periphery substantially corresponding to the outer periphery of said gasket strips and adapted to abut said outer periphery of said gasket strips so that said capping means covers the entire outer periphery of said gasket strips;

means projecting from the inner periphery of said capping means for securing said capping means in said locking strip cavity of said gasket strips; and pigment means coupled with said capping means for providing said capping means with color to provide the glazing system with a tinted aesthetic appearance.

10. The system according to claim 9 wherein said cap means comprises a plurality of elongated strips having an inner periphery substantially corresponding to the outer periphery of said gasket strips and including a member projecting from said inner periphery for securing said elongated strips in said cavities in said vertical and horizontal gasket strips, a plurality of joint fittings having a body portion and at least two leg portions, said leg portions abutting said elongated strips for providing a continuous covering on said gasket strips, and a means for coupling said joint fittings with said gasket strips.

11. The system according to claim 10 wherein said elongated strips and joint fittings are extruded from a polymeric material.

12. The system according to claim 11 wherein said polymeric material is Hyplon polymer.

13. The system according to claim 11 wherein said pigment means is added directly to said polymeric material prior to extrusion of the elongated strips.

14. The system according to claim 10 wherein said pigment means comprises a pigmented film layer applied to said elongated strips and joint fittings.

15. The system according to claim 10 wherein said elongated strips and joint fittings are formed from a metallic material.

16. The system according to claim 15 wherein said pigment means comprises a pigmented film layer applied to said elongated strips and joint fittings.

* * * * *